United States Patent [19]

Beeghly

[11] 4,176,643

[45] Dec. 4, 1979

[54] PULSE GENERATING AND DISTRIBUTING CIRCUITS FOR INTERNAL COMBUSTION ENGINES OR THE LIKE

[75] Inventor: Bruce R. Beeghly, Youngstown, Ohio

[73] Assignee: The Economy Engine Company, Youngstown, Ohio

[21] Appl. No.: 817,815

[22] Filed: Jul. 21, 1977

[51] Int. Cl.[2] ..... F02P 1/00; F02P 3/06

[52] U.S. Cl. ..... 123/146.5 A; 123/148 CC; 123/148 ND; 123/149 C; 315/209 SC

[58] Field of Search ..... 123/146.5 A, 148 R, 123/148 ND, 148 E, 148 CA, 148 CB, 148 CC, 149 C; 315/209 CD, 209 SC; 200/19 M

[56] References Cited

U.S. PATENT DOCUMENTS

| | | | |
|---|---|---|---|
| 3,240,198 | 3/1966 | Loudon et al. | 123/148 CC |
| 3,291,109 | 12/1966 | Neapolitakis | 123/148 E |
| 3,373,729 | 3/1968 | Lemen | 123/148 E |
| 3,408,993 | 11/1968 | Chavis | 123/148 E |
| 3,422,804 | 1/1969 | Van Mastrigt | 123/148 E |
| 3,426,740 | 2/1969 | Hufton et al. | 123/146.5 A X |
| 3,433,208 | 3/1969 | Dogadko et al. | 123/148 CB |
| 3,587,549 | 6/1971 | Kebbon et al. | 123/148 CB |
| 3,875,920 | 4/1975 | Williams | 123/148 E |
| 3,880,132 | 4/1975 | Whatley, Jr. | 123/148 R |
| 4,007,724 | 2/1977 | Mura | 123/148 CC |
| 4,056,088 | 11/1977 | Carmichael | 123/148 E |

*Primary Examiner*—Tony M. Argenbright

*Attorney, Agent, or Firm*—Webb, Burden, Robinson & Webb

[57] ABSTRACT

A breakerless pulse generating and distributing system in which sensor-switches (such as Hall effect switches and LED triggered switches) in a distributor transmit a timing pulse to one of a plurality of series connected power switches. The sensor-switches are powered by the timing pulses being transmitted and a constant current drain is avoided.

5 Claims, 4 Drawing Figures

Figure 1:
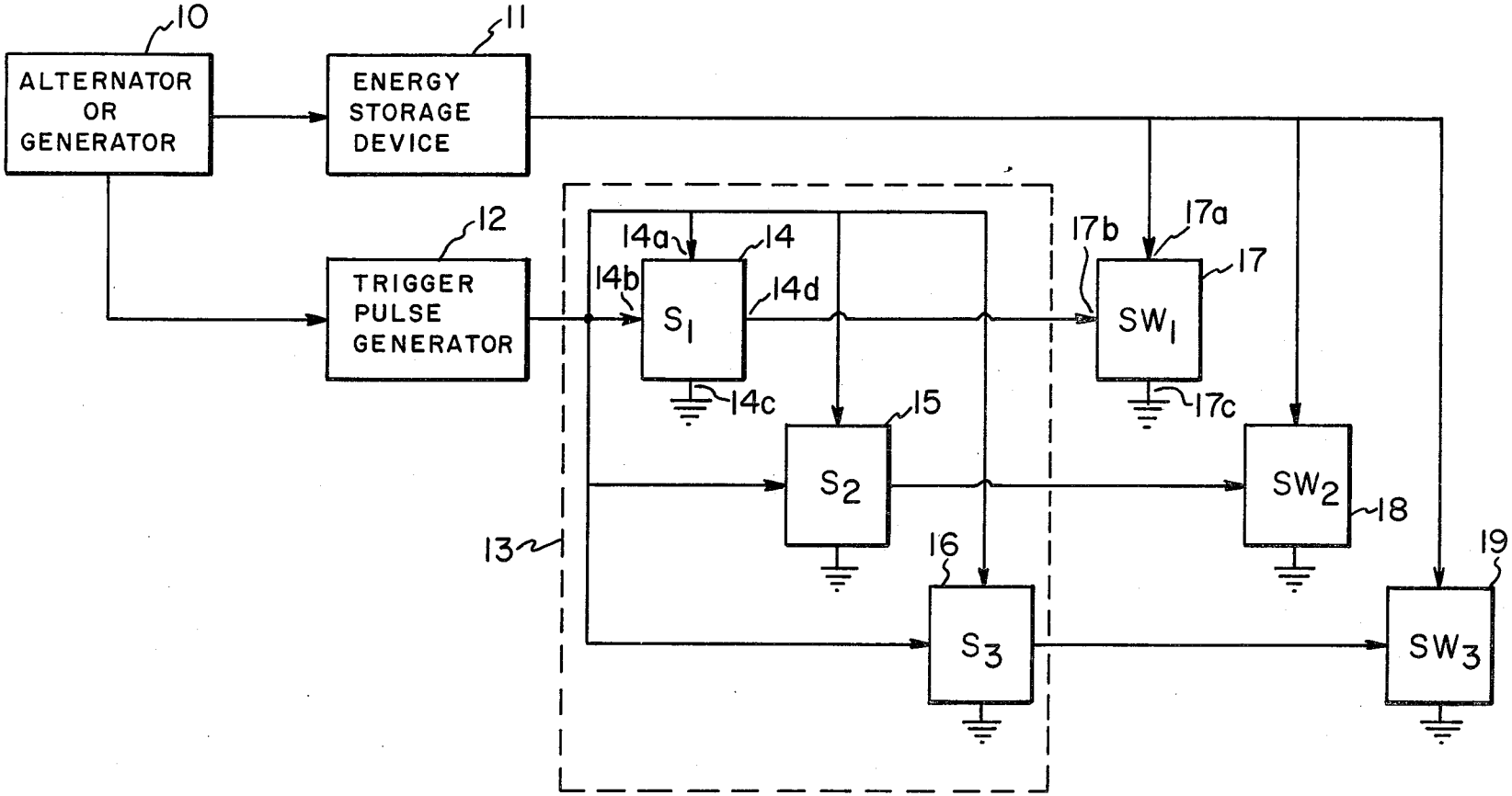

PULSE GENERATING AND DISTRIBUTING CIRCUITS FOR INTERNAL COMBUSTION ENGINES OR THE LIKE

BACKGROUND

This application relates to truly breakerless electronic self-powered ignition systems. No physical switches whatsoever are used in these systems. They are entirely solid-state with the associated solid-state reliability.

There are a number of electronic ignition systems available for internal combustion engines in which the breaker points have been eliminated by use of electronic switches. Still further, mechanical distributors in which a rotating electrode or brush establishes physical contact with poles associated with each spark plug have been replaced with magnetically activated switches such as reed switches and mercury switches. These are not, however, truly breakerless distributors as mechanical action (caused by moving a magnetic pole near the switch) is still involved. This invention relates to a truly breakerless or solid-state ignition and distribution system.

This application is particularly directed to self-powered ignition systems; that is, those having no auxiliary electric power source (such as a battery) available at start-up. These ignition systems are powered by DC current generators, alternators, and magnetos.

While, for the most part, this application is directed to ignition systems, i.e., means for creating a spark in a cylinder of an internal combustion engine at the appropriate instance in the engine cycle, it is also directed to fuel injection systems in which fuel is injected into cylinders near the end of the compression stroke. Since electrical pulses are used to activate fuel injection solenoids in fuel ignition systems, this invention is useful in both spark ignitions and fuel injection systems.

Breakerless distributors require electronic sensing devices. These sensing devices, in cooperation with a rotating element, perform the indexing function previously performed by the rotating brush and poles of prior art distributors. A number of electronic sensing devices are available. However, they have not found use with ignition systems and especially with self-powered ignition systems due to the supply current requirement. Magnetically operated Hall effect switches and LED triggered photosensitive electronic switches are two such electronic sensing and switching devices. The supply current requirements for the sensor element (for example, the Hall element in the Hall effect switch and the LED of the LED trigger switch) can equal or exceed the operating current requirement of the ignition circuit itself. For example, in the case of a Hall element a supply current of 4 to 10 milliamps is required and if low tension electronic distribution is required one Hall element per cylinder is also required. Connected in parallel then, a 10 cylinder system would require 40 to 100 milliamps of supply current. The LED (light emitting diode) supply current can be 20 to 100 milliamps. Now then, a typical supply current for an entire ignition system may only be 40 to 100 milliamps. While it is conceivable that the supply current for the sensing elements could be supplied at the normal running speed of the engine, at cranking or starting speeds (rpm) the generator output is far too low (a few milliamps at best). Hence, electronic sensing devices with an associated current drain have not been used in ignition systems and the like.

Briefly, according to this invention there is provided a breakerless pulse generating and distributing system comprising an energy storage means such as a storage capacitor and means for charging the energy storage means. A plurality of electronic power switches in parallel are each arranged to discharge the energy storage means. A pulse generator is arranged to generate a timing pulse at given angular positions of a rotating member. A distributor comprises a plurality of electronic sensor-switches for passing the timing pulse to the control terminal of the power switches. Each sensor-switch has a power supply terminal and an associated current drain. The power supply terminals of the sensor-switches are connected to the pulse generator. The sensor-switches are individually activated by a breakerless means associated with a rotating member at given angular positions thereof. In this way, each sensor-switch is arranged to pass the timing pulse to the control terminal of a corresponding electronic power switch when the breakerless means is indexed with a sensor-switch. The sensor-switch thereby drains current only during the timing pulses.

Figure 2:
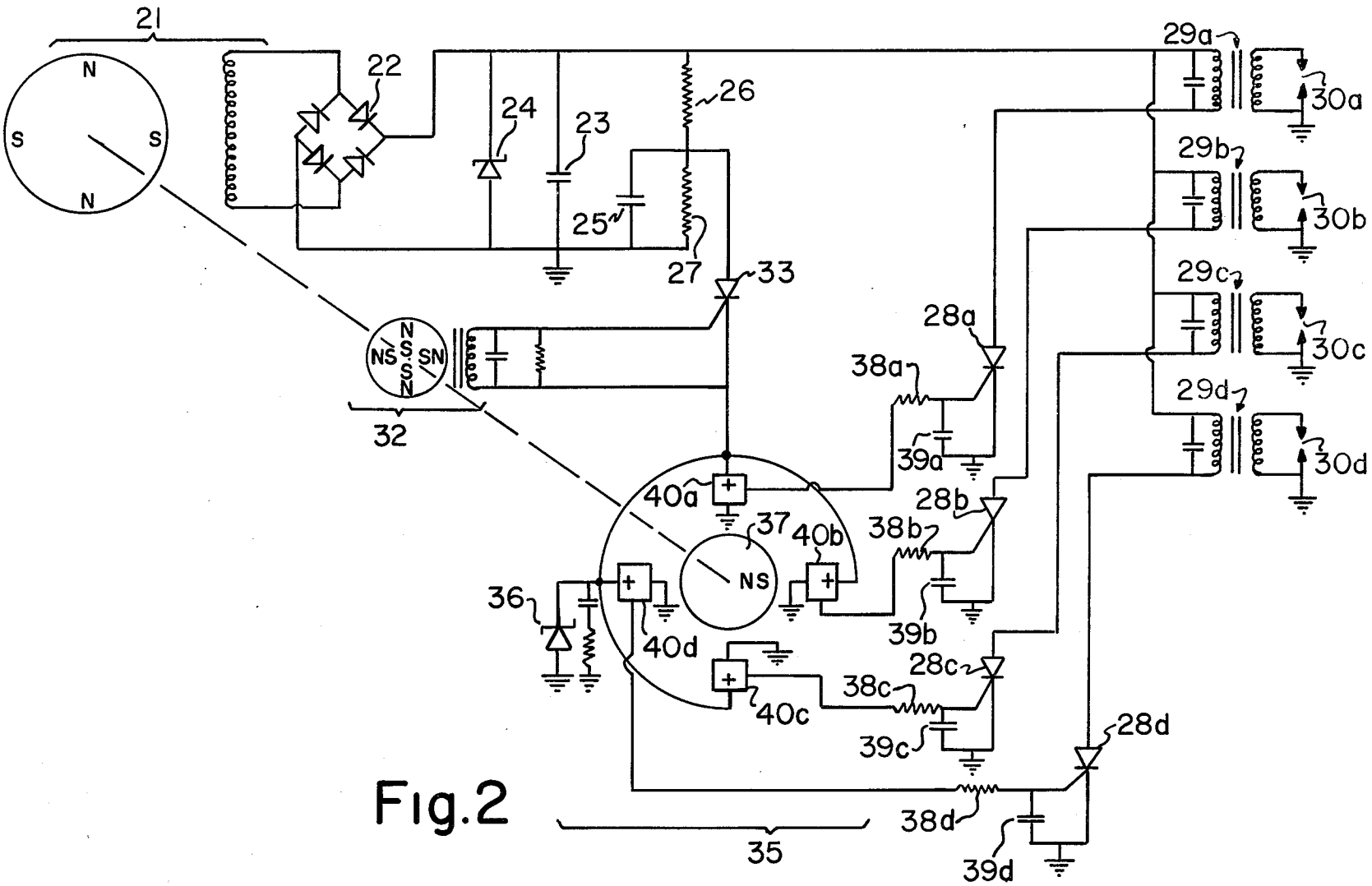
Figures 3, 4:
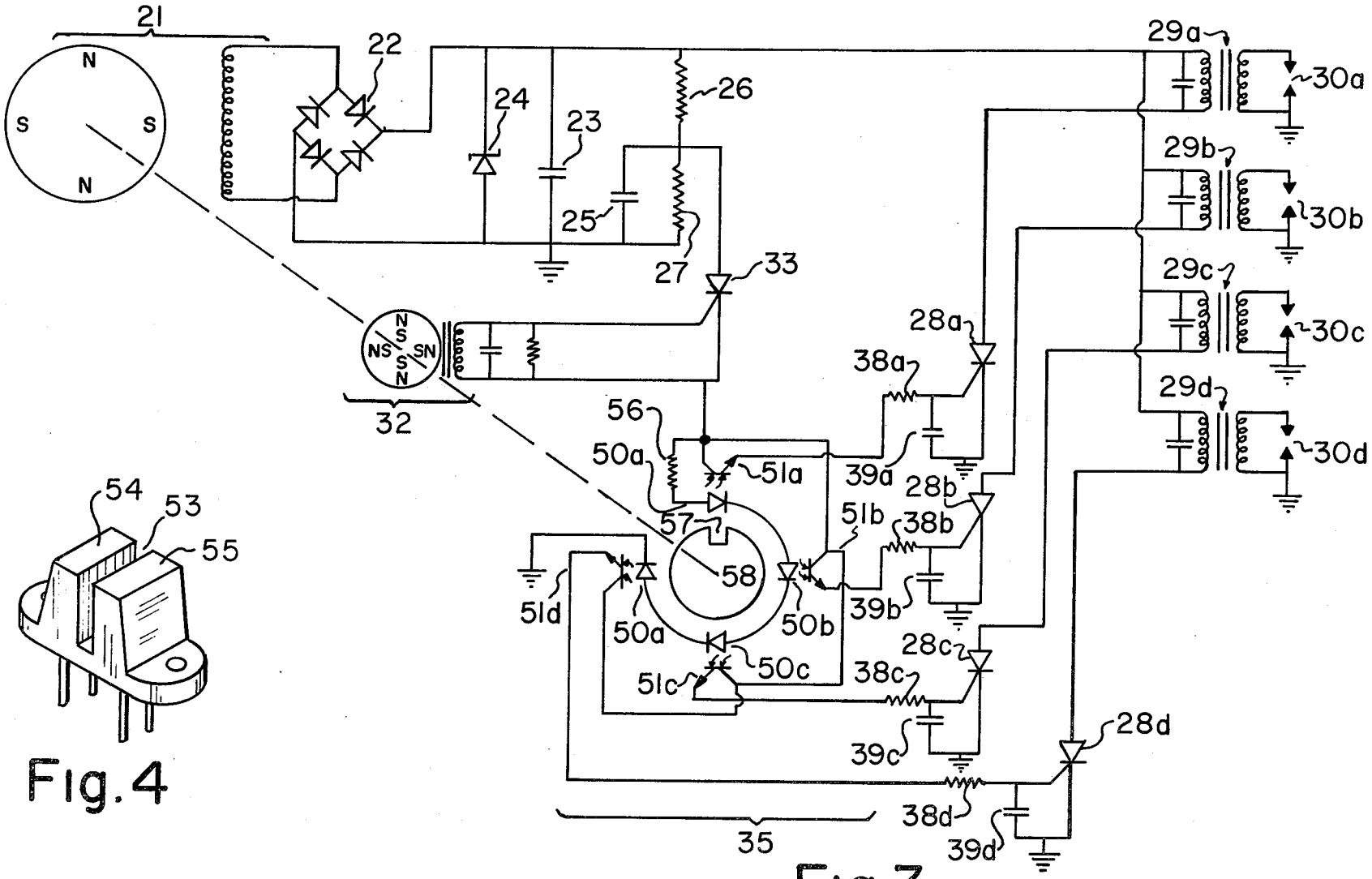

Further features and other objects and advantages of this invention will become clearer from the following detailed description made with reference to the drawings, in which FIG. 1 is a block diagram of the basic system, FIG. 2 is a circuit diagram of an ignition system in which Hall effect devices are used, and FIG. 3 is a circuit diagram of an ignition system in which light emitting diode triggered switches are used.

FIG. 4 is a perspective view of a commercially available LED switch fixture.

Referring now to FIG. 1, a pulse generating and distributing system according to this invention comprises a DC generator or alternator 10 for supplying a DC current to the energy storage device 11 (for example, a storage capacitor) and to the timing pulse generator 12. The generator or alternator need not have a greater current capacity than those used in similar systems having mechanical switch distributors. The timing pulse is applied to the distributor system 13 which comprises a plurality of electronic sensor-switch elements 14, 15 and 16. The distributor passes the timing pulse to one of a plurality of power switches 17, 18 and 19 releasing the energy stored on the energy storage device. The power switches are arranged in parallel circuits.

The sensor-switch elements have associated therewith a power supply terminal (**14*a* for sensor-switch 14) and a ground terminal 14*c* through which a continuous current drain takes place as long as the power supply terminal is connected to a current supply. The sensor-switch elements also have input terminals 14*b* and output terminals 14*d* for passing the timing pulse. Three conditions must be met for a sensor-switch to pass the timing pulse: (1) the pulse must be applied to the sensor-switch input, (2) the sensor-switch power supply terminal must be energized, and (3) the physical condition (for example, proximity of a magnetic pole) which activates the sensor must exist. Most distributors have a rotating element that brings about the third condition with every rotation thereof. The trigger pulse is passed through the distributor 13 to a selected power switch, say 17, and applied to the trigger or gate terminal 17*b*** thus placing the power switch in its conducting condition.

Pulse generating and distributing systems according to this invention use sensor-switches with a continuing current drain characteristic. However the timing pulse is applied to both the power supply terminal and the input terminal and in this way current drain only takes place during the timing pulse.

Referring now to FIG. 2 there is shown a capacitor discharge ignition system self-powered by an alternator 21. The output of the alternator is supplied to a full wave rectifier 22 and charges storage capacitor 23 to a voltage controlled by zener diode 24. A small capacitor 25 is charged through the voltage divider comprising resistors 26 and 27. Four parallel discharge circuits comprise electronic switches 28*a*, 28*b*, 28*c* and 28*d* for discharging the storage capacitor 23 through the primary windings of transformers 29*a*, 29*b*, 29*c* and 29*d* respectively. The secondary circuits of the coils are in series with spark plugs 30*a*, 30*b*, 30*c* and 30*d* respectively.

A pick-up pulse is created by a small generator 32. It is applied to the gate of solid state switch 33 permitting the discharge of small capacitor 25, thus creating a trigger or timing pulse. The timing pulse is then applied to the electronic distributor 35. A zener diode 36 limits the timing pulse voltage. A resistor and capacitor in parallel with zener diode 36 help to suppress noise at the input to the distributor.

The distributor has a rotating element 37 which carries a magnet in a circular path. Circumferentially spaced about the rotating element 37 are Hall effect sensor-switches 40*a*, 40*b*, 40*c* and 40*d*.

Each Hall effect sensor-switch is a Hall sensor with a trigger circuit and amplifier integrated on a silicon chip. The switches are activated by the proximity of a magnetic field. No physical contact exists between the activating magnet and the sensor-switch. The devices are sold by MICRO SWITCH, for example. A permanent magnet is mounted on the rotating element of the distributor and it is rotated into the switch activating position with each revolution.

The trigger pulse or timing pulse, which is the output of the switch 33, is applied to the common power supply and input terminal of each sensor-switch 40*a*, 40*b*, 40*c* and 40*d*. The output of the sensor-switches is applied to the gate terminals of power switches 28*a*, 28*b*, 28*c* and 28*d* respectively. Preferably resistors 38 are provided in series with the gates of the electronic switches 28 and capacitors 39 are provided from the gate of the switches to ground. This reduces noise returned to the distributor from the electronic switches (initiated by spark breakdown) which noise can cause cross-firing. The alternator 21, pick-up pulse generator 32 and rotating distributor element 37 can all be on the same shaft or on different shafts geared together.

Referring now to FIG. 3 there is illustrated a pulse generating and distributing system according to this invention in which the sensor-switches of the distributor are LED triggered switches, sometimes referred to as photon coupled interruptors. The basic elements of the circuits of FIGS. 2 and 3 are identical and identical elements are given identical identifying numerals.

The LED triggered switches comprise LED's 50*a*, 50*b*, 50*c* and 50*d* and silicon phototransistors 51*a*, 51*b*, 51*c* and 51*d* respectively. The switches are commercially available in a fixture (see FIG. 4) which holds the light emitting diodes and the phototransistors spaced apart across the slot 53. On one side of the slot, a mounting 54 is provided for the diode and on the other side, a mounting 55 is provided for the phototransistor. A disc shaped baffle 58 with a gap 57 in the periphery is rotated through the slot 53. When the gap 57 rotates into the slot 53, energy from the LED (for example, a gallium arsenide infrared emitting diode) is permitted to reach the silicon phototransistor, thus switching the transistor from "OFF" to "ON." The disc then comprises the rotating element of the distributor.

As shown in FIG. 3, the LED of each sensor-switch combination is electrically connected in series with each other LED and with a current limiting resistor 56. When the resistor is connected to a power source the LED series circuit will comprise a constant current drain. According to this invention, the LED series circuit is connected to the output of switch 33 and, therefore only drains current during the timing pulse.

OPERATION

Applicant's invention relates to the use of an electronic sensor-switch and in reversing the normal operating sequence of the electronic sensor-switch. Normally the supply current is present continuously and a physical phenomena (alignment of a magnet or shield with the sensor) causes a change in output. In applicant's pulse generating and distributing circuits the physical alignment takes place first and then all the sensors in the distributor are pulsed simultaneously. Only the sensor switch, which is aligned (with the magnet or gap in the baffle) transmits the timing pulse. This enables the supply current to be supplied in pulse form from a charged capacitor thus causing very low current drain from the system generator.

Having thus described my invention with the detail and particularity as required by the Patent Office, what is desired protected by Letters Patent is set forth in the following claims.

I claim:

1. A self-powered breakerless pulse generating and distributing system for an internal combustion engine comprising, a storage capacitor, means for generating a current for charging said capacitor, a plurality of electronic power switches in parallel circuits associated with each cylinder of the engine for discharging the storage capacitor, a pulse generator comprising a rotating member turning in synchronism with said engine arranged to generate timing pulses at given angular positions, a distributor comprising a rotary member turning in synchronism with said engine and a plurality of Hall effect switches having input, output and power supply terminals, each Hall effect switch arranged to pass a timing pulse to one of said electronic switches when the rotary member is indexed therewith, each Hall effect switch power supply terminal having a current drain associated therewith, each Hall effect switch input and power supply terminal being connected to the output of the pulse generator, such that each Hall effect switch is arranged to pass the timing pulse to the control terminal of a corresponding power switch when the rotary member is indexed with said Hall effect switch and such that Hall effect switches only drain current during the timing pulse.

2. The self-powered breakerless pulse generating and distributing system according to claim 1 in which the storage capacitor discharges to the primary of a step-up coil, the secondary of which is in series with a spark plug.

3. The self-powered breakerless pulse generating and distributing system according to claim 1 in which a series resistor is provided between the distributor and the control terminal of each electronic power switch and a capacitor is provided between the control terminal of each electronic power switch and ground.

4. A self-powered breakerless pulse generating and distributing system for an internal combustion engine comprising, a storage capacitor and a trigger capacitor, means for generating a current for charging said capacitors, a plurality of electronic power switches in parallel circuits associated with each cylinder of the engine for discharging the storage capacitor, a pulse generator comprising a rotating member in synchronism with said engine arranged to generate timing pulses by discharging the trigger capacitor at given angular positions of said rotating member, a distributor comprising a rotary member turning in synchronism with said engine and a plurality of electronic Hall effect switches having input, output and power supply terminals each Hall effect switch arranged to pass a timing pulse to one of said electronic switches when the rotary member indexes therewith, each Hall effect switch having a power supply terminal and a current drain associated therewith, each Hall effect switch power supply terminal being connected to the output of the pulse generator, such that each Hall effect switch is arranged to pass the timing pulse to the control terminal of a corresponding power switch when the rotary member is indexed with a Hall effect switch and such that Hall effect switches only drain current during the timing pulse.

5. The self-powered breakerless pulse generating and distributing system according to claim 4 in which a series resistor is provided between the distributor and the control terminal of each electronic power switch and a capacitor is provided between the control terminal of each electronic power switch and ground.

* * * * *